United States Patent [19]

Seppanen

[11] Patent Number: 4,989,352

[45] Date of Patent: Feb. 5, 1991

[54] BASEPLATE

[76] Inventor: Tauno Seppanen, Solnantie 35 A, 00330 Helsinki, Finland

[21] Appl. No.: 476,359

[22] Filed: Feb. 7, 1990

[30] Foreign Application Priority Data

Feb. 7, 1989 [FI] Finland ..... 890565

[51] Int. Cl.[5] ..... A44C 3/00

[52] U.S. Cl. ..... 40/1.5; 40/642; 63/20; 24/706.2

[58] Field of Search ..... 40/1.5, 642, 1.6, 662; 63/20; 24/706.2, 707.2, 707.6, 709.8

[56] References Cited

U.S. PATENT DOCUMENTS

| | | | |
|---|---|---|---|
| 291,564 | 1/1984 | Adams | 63/20 |
| 893,237 | 7/1908 | Gifford | 63/20 |
| 2,341,467 | 2/1944 | Nedell | 40/1.5 |
| 3,806,997 | 4/1974 | Niwa | 40/1.5 |
| 4,183,159 | 6/1980 | Isaac | 40/1.6 |
| 4,518,080 | 5/1985 | Ohlson | 40/1.5 |
| 4,597,206 | 7/1986 | Benson | 40/1.5 |

FOREIGN PATENT DOCUMENTS

| | | | |
|---|---|---|---|
| 2137585 | 10/1984 | United Kingdom | 40/1.5 |
| 2194768 | 3/1988 | United Kingdom | 40/1.5 |

*Primary Examiner*—Eric K. Nicholson
*Assistant Examiner*—F. Saether
*Attorney, Agent, or Firm*—Lorusso & Loud

[57] ABSTRACT

A baseplate to which a label may be attached for name tags, signs, and the like which fits in a frame for group identification, and which has an interlocking U-shaped pin for fastening the baseplate to garments. The baseplate has a recess with a step, longitudinal openings, and a stop member in order to fix the pin in place, and a second stop member with a notch in order to close the pin. The baseplate including the recess, openings, step, and stops may be formed from a single piece of plastic during one working stage.

12 Claims, 3 Drawing Sheets

BASEPLATE

BACKGROUND OF THE INVENTION

The present invention is directed to a baseplate for labels such as name tags, signs, symbols, and the like which may be fixed on the face of the baseplate In various kinds of conferences, seminars exhibitions, training courses and similar occasions, name tags are often distributed to the participants. The name tags are fastened to garments by means of plastic covers or casings provided with a safety pin or a corresponding fastening means. A baseplate of the above type is disclosed in Finnish patent application Ser. No. 854,533 to Seppanen. That application discloses a baseplate with a pin fixed into a recess either by a label adhered over the recess or by bending the edges of the recess at least one point such that a portion of the baseplate covers the pin. This method of fixing the pin in place makes special demands on the label or requires an additional working stage when the edge of the recess is bent over the pin. Moreover, it is necessary to use designations on the labels to differentiate groups, e.g., different departments, home offices, etc. from one another since known baseplates have indistinguishable visual features.

Accordingly, it is an object of the present invention to provide a baseplate with a detachable pin such that the pin may be fixed in place on the baseplate without requiring the use of special labels and without requiring an additional working stage in the production of the baseplate.

It is a further object of the present invention to provide a baseplate such that name tags belonging to different groups of persons may be distinguished visually without having to read the labels on the baseplates.

SUMMARY OF THE INVENTION

A baseplate is provided which may be used to make name tags, signs, and symbols in a simple and inexpensive manner The baseplate defines a hollow recess and has openings at specific points on both faces of the baseplate. On the back of the baseplate, a stop protrudes from the baseplate at one end of the recess. The stop adjoins a single opening on the back. The stop maintains a U-shaped pin in place by pressing the bent end of the pin down into the recess. A second stop protrudes from the back of the baseplate at a point just beyond the opposite end of the recess from the first stop. The second stop fixes the pin in a closed position in order to prevent the baseplate from falling off a garment when the baseplate is attached and in order to prevent the pin from sticking someone when the pin is unattached. On the front of the baseplate, an opening at the end of the recess near the second stop facilitates the insertion of the pin in the baseplate. There is a second opening on the front at the opposite end of the recess from the first opening on the front together with a step between the two openings on the front. The step facilitates the insertion and maintenance of the pin in proper position. The second opening on the front makes it easier to produce the baseplate. In a referred embodiment, the baseplate has a ledge formed by extending the front face of the baseplate. A colored or uniquely patterned frame for group identification snaps over the ledge of the baseplate so that the color or Pattern of the frame is visible from the front of the baseplate.

The invention is described in greater detail below with reference to the drawings in which like numerals reference like parts.

DETAILED DESCRIPTION OF THE INVENTION

At the outset, the invention is described in its broadest overall features after which it is described with more particularity. In its broadest overall aspects, the invention consists of a baseplate with a frame for identifying different groups of baseplates. A label may be attached to the front face of the baseplate for identifying individuals such that the baseplate may serve as a name tag or similar device. The baseplate also contains stop members for fixing one end of a U-shaped pin in a recess in the baseplate and for securing the other end of the pin against the baseplate so that the baseplate may be easily attached and detached from the clothing of a person bearing the baseplate. The baseplate may be constructed by extruding it from plastic material. All of the details which are required for fitting the pin and label to the baseplate are molded during a single production process.

Figure 1:
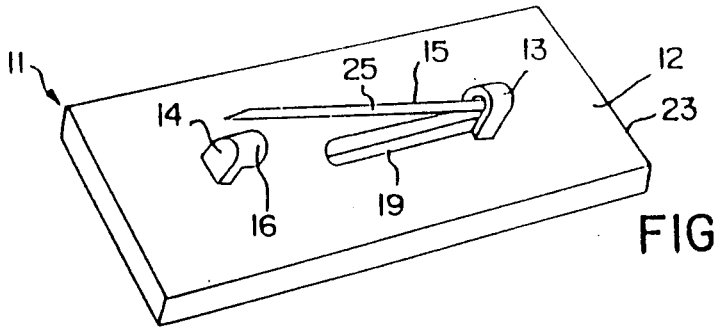
FIG. 1 is a perspective view of the back of the baseplate of the present invention with the U-shaped pin inserted.
Figure 2:
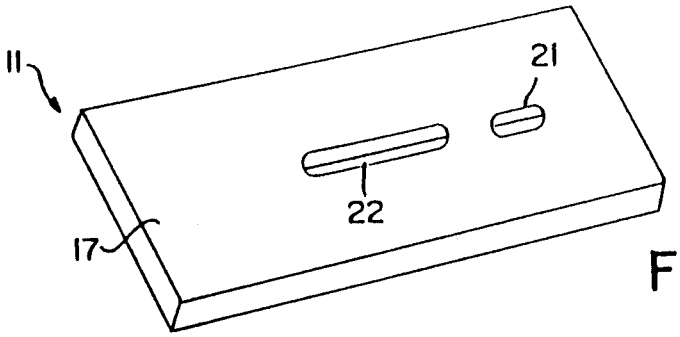
FIG. 2 is a perspective view of the front of the baseplate of FIG. 1 with the pin inserted.
Figure 3:
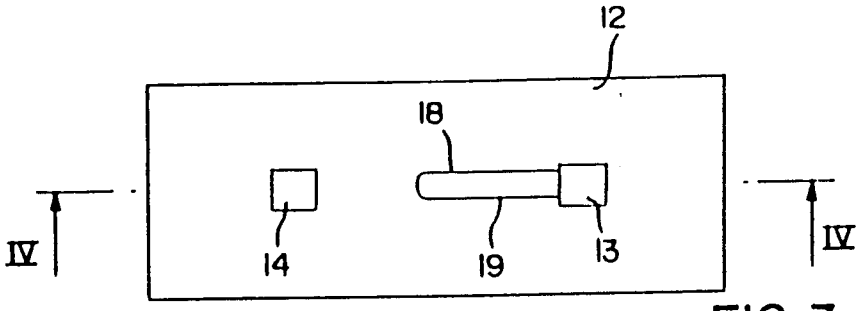
FIG. 3 is a view of the back of the baseplate of the present invention without the pin.

Referring now to FIG. 1, the baseplate 11 has a longitudinal opening 19 in its back 12 which is positioned such that the opening 19 is centered along the width of the baseplate but is off-center along the length of the baseplate. The opening 19 connects to a hollow recess 18 inside the baseplate 11. At the end of the opening 19 nearest an edge 23 of the baseplate, a first stop member 13 protrudes from the back of the baseplate. The stop 13 fixes a U-shaped pin 15 in the recess 18 by preventing the pin 15 from sliding laterally and by pushing the pin 15 down into the recess 18 When the pin 15 is properly inserted, it may be closed by pinning the free end 25 of the pin 15 under a second stop member 14 located on the back 12 of the baseplate 11 and just beyond the opposite end of the recess 18 from the stop 13. The second stop 14 is constructed with a locking notch 16 such that it easily receives the free end 25 of the pin 15 and prevents the accidental release of the pin end 25 while at the same time allowing easy removal of the pin end 25 from the notch 16 and stop 14 when the bearer of the baseplate 11 seeks to remove it. On the front 17 (FIG. 2) of the baseplate 11, an opening 22 at the end of the recess 18 near the second stop 14 facilitates the insertion of the pin 15 into the baseplate 11. In addition, a second opening 21 on the front 17 near the end of the recess 18 next to the first stop 13 makes construction of the baseplate 11 easier. A step 20 between the openings 21, 22 facilitates the insertion of the pin 15 into the recess 18 and the maintenance of the pin 15 in proper position. FIG. 3 shows the rear of the baseplate without the pin.

The baseplate 11 of the invention is made by extrusion molding of suitable plastic material. In the production process, the baseplate 11, first stop member 13, second stop member 14, notch 16, recess 18, step 20, and openings 19, 21 and 22 may be made from one piece of plastic during a single working stage. Production is fast and makes possible the use of different types of plastic raw material.

Figure 4:
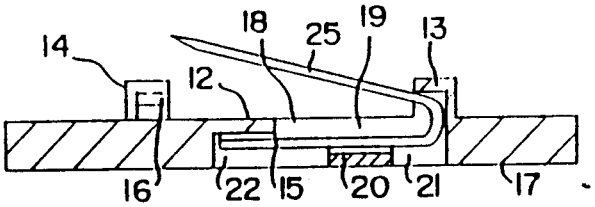
FIG. 4 is a cross-sectional view of the baseplate taken along the line 4—4 in FIG. 3 and with the pin inserted.
Figure 5:
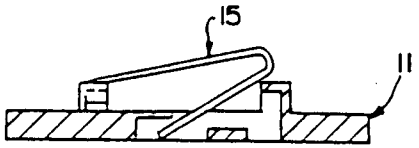
FIG. 5 is a cross-sectional view of the baseplate as shown in FIG. 4 with the pin at its initial stage of insertion.
Figure 6:
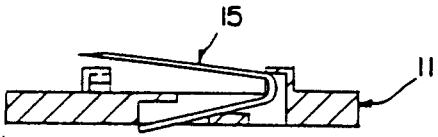
FIG. 6 is a cross-sectional view of the baseplate as shown in FIG. 4 with the pin inserted below the stop.
Figure 7:
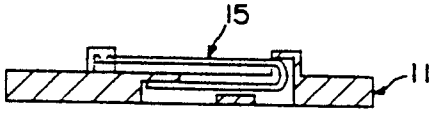
FIG. 7 a cross-sectional view of the baseplate as shown in FIG. 4 with the pin closed.

To a baseplate 11 made in this manner is fitted a pin 15 bent into a U-shaped one end 25 o: which can be sharpened into a point to facilitate attachment to a garment. As shown in FIG. 4, the length of the recess 18 corresponds to the length of the pin 15 which is inserted into the recess 18. The pin 15 is inserted into the baseplate 11 as shown in FIGS. 4–7 and as follows. The pin 15 is pushed in a slanting position through the opening 19 into and through the recess 18 and out through the opening 22 on the other face 17 of the baseplate 11 (FIG. 5). The bent part of the pin 15 is pushed into the stop 13 (FIG. 6). The step 20 and opening 21 ensure that the pin 15 remains locked in the recess 18 and maintains its U-shaped conformation. Because the portion of the pin 15 in the recess 18 corresponds to the length of the recess 18 the pin 15 is prevented from moving longitudinally while the stop 13 and step 20 prevent the pin 15 from coming loose from the baseplate 11. There is no need to take any further measures to secure the pin 15. The pin 15 is shown fully inserted in FIG. 4, and is shown with the free end 25 secured in the notch 16 of the second stop 14 with the pin 15 closed in FIG. 7.

While the opening 21 facilitates baseplate production, it is not essential, and it is possible to provide the recess 18 only with the step 20 for maintaining the bend in the pin 15.

Figure 8:
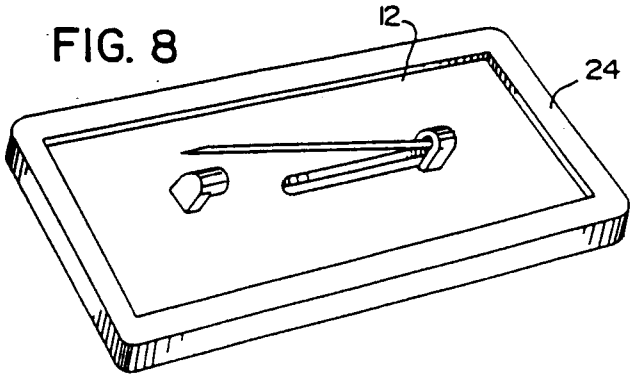
FIG. 8 is a perspective view of the back of the preferred embodiment of the invention with the frame for group identification attached and with the pin inserted.
Figure 9:
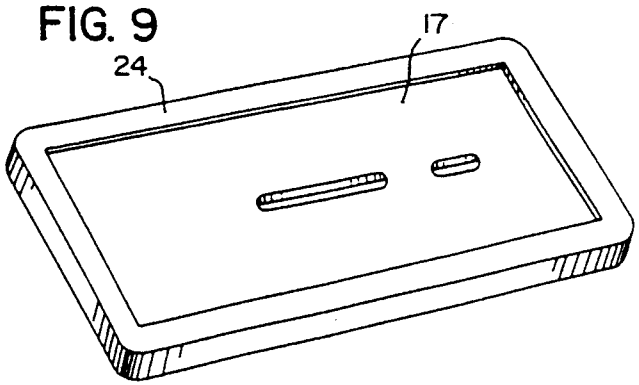
FIG. 9 is a perspective view of the front of the preferred embodiment of the invention with the frame attached and with the pin inserted.
Figure 10:
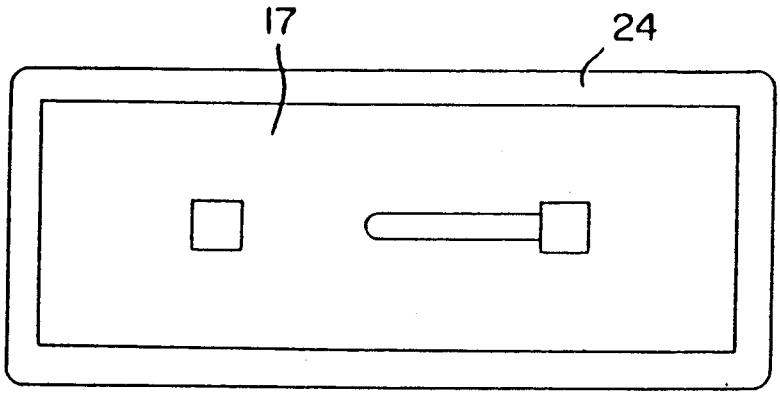
FIG. 10 is a rear view of the preferred embodiment of the invention with the frame attached.
Figure 11:
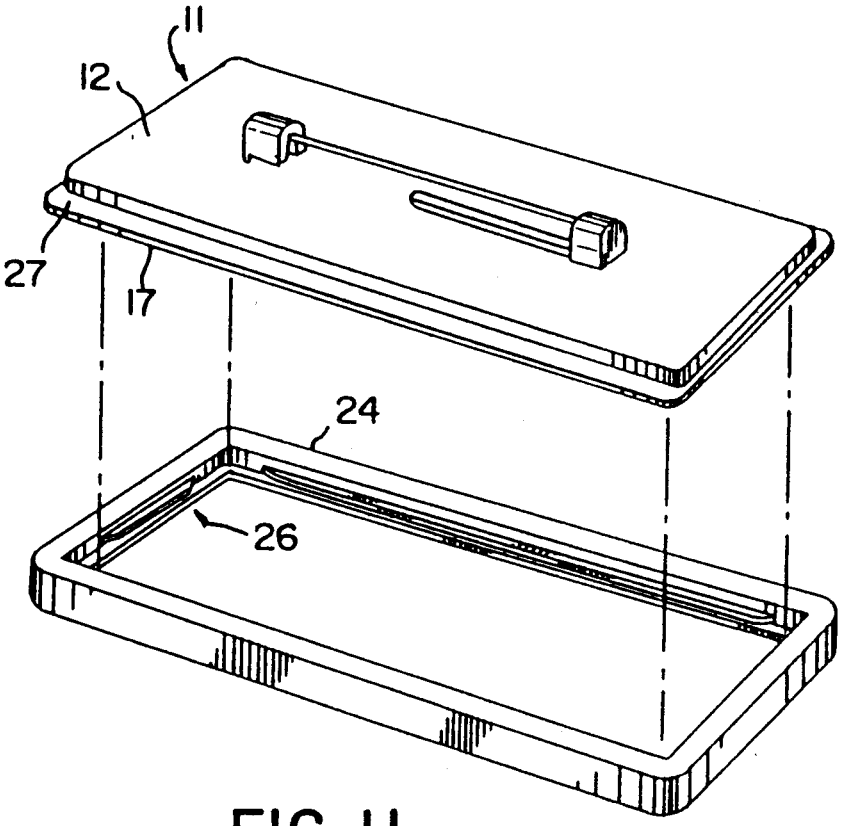
FIG 11 is an exploded view of the preferred embodiment of the invention and the frame showing the ledge on the baseplate and the groove in the frame and with the pin inserted.

In a preferred embodiment, the face 17 of the baseplate 11 is slightly extended beyond the back 12 to create a ledge 27. The frame 24 snaps easily on and off of the baseplate 11 in its preferred embodiment. FIGS. 8–10 show the frame 24 attached to the baseplate 11. FIG. 11 shows the frame 24 unattached to the baseplate 11, and in particular shows that the baseplate 11 may snap easily into the groove 26 of the frame 24 which is designed to hold the baseplate 11 snugly. The frame 24 codes the baseplates by color, pattern, or similar device such that groups of related individuals may be identified solely by looking at the frame 24 and without having to read labels which may be attached to the baseplates.

In a similar embodiment the baseplate may be thought of in four layers the rectangular face of the baseplate, the smaller rectangular baseplate itself, a third still smaller rectangular layer which defines the longitudinal slot on the back of the baseplate and which lies on the baseplate to define the recess, and the stop members which rest on the third layer. The four layers are formed integrally in a single piece of plastic.

While the foregoing invention has been described with reference to its referred embodiments, it should not be limited to such embodiments since various alterations and modifications will occur to one skilled in the art. Rather the scope of the invention is to be governed by the appended claims and all such variations and modifications are intended to fall within the scope of the claims.

I claim:

1. A name tag comprising a baseplate, a U-shaped pin, said baseplate having a front and a back and four edges and being substantially longer than it is Wide and defining a longitudinal recess, said baseplate defining a first longitudinal opening on the back of said baseplate at an end of said recess, said first opening being coincident with and shorter in length than said recess, said baseplate also having a first stop member on said back at the end of the recess near said first opening, said baseplate having a second stop member on said back near the opposite end of said recess from said first stop member but beyond the end of said recess, said second stop member having a notch for locking a free end of said pin in a closed position, said baseplate also having a step adjacent into said recess on the front of said baseplate, said baseplate defining a second longitudinal opening on the front of said baseplate at the end of said recess between said stop members and closer to said second stop member, said second opening on said front being coincident with and substantially shorter in length than said recess, said second opening overlapping said first opening such that a first hole is formed through said baseplate, said U-shaped pin having a first branch and a second branch and being fixable to said baseplate without extrinsic fastening means, said first branch locking into said recess when said pin is fixed to said baseplate, and said second branch being slightly longer than said first branch such that said second branch extends into said notch on said second stop member when the pin is in the closed position.

2. The name tag of claim 1 wherein said recess is centered along the length and width of said baseplate.

3. The name tag of claim 1 wherein said first hole is a short longitudinal slot.

4. The name tag of claim 2 wherein said baseplate defines a third longitudinal opening on said front of said baseplate at the end of said recess opposite said second opening, said third opening being coincident with and substantially shorter in length than said recess, said third opening also being coincident with and shorter in length than said first opening such that a second short longitudinal hole is formed through said baseplate.

5. The name tag of claim 1 further comprising a frame, said face of said baseplate being slightly larger than said back and forming a ledge which fits removably into a rectangular groove on said frame.

6. The name tag of claim 1 wherein said first branch of said U-shaped pin has a length equal to the length of said recess.

7. The name tag of claim 1 Wherein said baseplate is made from a single piece of plastic material during a single working stage.

8. The name tag of claim 2 wherein said baseplate is made from a single piece of plastic material during a single working stage.

9. The name tag of claim 3 wherein said baseplate is made from a single piece of plastic material during a single working stage.

10. The name tag of claim 4 wherein said baseplate is made from a single piece of plastic material during a single working stage.

11. The name tag of claim 5 wherein said baseplate is made from a single piece of plastic material during a single working stage.

12. A name tag comprising a baseplate, a frame, and a U-shaped pin, said frame defining a groove, said baseplate having a front and a back and four edges and being substantially longer than it is wide and defining a longitudinal recess, said face being slightly larger than said back and forming a ledge which fits removably into said groove on said frame, said recess being centered along the length and width of said baseplate, said baseplate defining a first longitudinal opening on the back of said baseplate at one end of said recess, said first opening being coincident with and shorter in length than said recess, said baseplate also having a first stop member on said back at the end of the recess near said first opening, said baseplate having a second stop member on said back near the opposite end of said recess from said first stop member but beyond the end of said recess, said second stop member having a notch for locking a free end of said pin in a closed position said baseplate al-so having a step adjacent said recess on the front of said baseplate, said baseplate defining a second longitudinal opening on the front of said baseplate at the end of said recess between said stop members and closes said second stop member, said second opening on said front being coincident with and substantially shorter in length than said recess, said second opening over lapping said first opening such that a short longitudinal hole is formed through said baseplate, said baseplate defining a third longitudinal opening on said front of said baseplate at the end of said recess opposite said second opening, said third opening being coincident with and substantially shorter in length than said recess, said third opening also being coincident with and shorter in length than said first opening such that a second short longitudinal hole is formed through said baseplate, said baseplate being made from a single piece of plastic material during a single working stage, said U-shaped pin having a first branch and a second branch and being fixable to said baseplate without extrinsic fastening means, said first branch having a length equal to the length of said recess and locking into said recess when said pin is fixed to said baseplate, and said second branch being slightly longer than said first branch such that said second branch extends into said notch on said second stop member when the pin is in the closed position.

* * * * *